US005417066A

United States Patent [19]

Kawano et al.

[11] Patent Number: 5,417,066

[45] Date of Patent: May 23, 1995

[54] STIRLING ENGINE

[75] Inventors: Shin Kawano, Kariya; Tatsuo Inoue, Anjo, both of Japan

[73] Assignee: Aisin Seiki Kabushiki Kaisha, Kariya, Japan

[21] Appl. No.: 206,680

[22] Filed: Mar. 7, 1994

[30] Foreign Application Priority Data

Mar. 8, 1993 [JP] Japan ..... 5-046694

[51] Int. Cl.[6] ..... F02G 1/055

[52] U.S. Cl. ..... 60/517; 60/526

[58] Field of Search ..... 60/516, 517, 518, 519, 60/525, 526

[56] References Cited

U.S. PATENT DOCUMENTS 4,255,929 3/1981 McDougal ..... 60/517

4,984,428 1/1991 Momose et al. ..... 60/517

*Primary Examiner*—Ira S. Lazarus

*Assistant Examiner*—L. Heyman

*Attorney, Agent, or Firm*—Burns, Doane, Swecker & Mathis

[57] ABSTRACT

In a Stirling engine, a thermal isolating space is provided between an expansion space and a heating portion so as to establish a thermal isolation of the expansion space from the heating portion.

3 Claims, 3 Drawing Sheets

STIRLING ENGINE

BACKGROUND OF THE INVENTION

The present invention relates to a Stirling engine.

In general, in a Stirling engine which is disclosed, for example, in the U.S. Pat. No. 4,984,428, an expansion space is positioned adjacent to a heating portion and a thermal connection therebetween is established. Thus, the temperature in the vicinity of the expansion space becomes extremely high, which results in that the raw material and the structure of the expansion piston are restricted in order to prevent a short life of the expansion piston. Similar restrictions lie in a piston ring provided on an outer surface of the expansion piston.

SUMMARY OF THE INVENTION

It, therefore, an object of the present invention is to provide a Stirling engine which is free from the foregoing restrictions.

Another object of the present invention is to provide a Stirling engine in which a thermal connection between an expansion space and a heating portion is eliminated.

In order to attain the foregoing objects, a Stirling engine is comprised of a compression space defined in a compression cylinder and a compression piston fitted therein; an expansion space defined in an expansion cylinder and an expansion piston fitted therein; an operating space constituted between the compression space and the expansion space and filled with an operating fluid; a set of a cooling portion, a regenerator and a heating portion arranged in this order from the compression space to the expansion space and provided in the operating space; and a thermal insulating space provided between the expansion space and the heating portion.

BRIEF DESCRIPTION OF THE DRAWINGS

The above and other objects, features and advantages of the present invention will be more apparent and more readily appreciated from the following detailed description of preferred exemplarily embodiments of the present invention, taken in connection with the accompanying drawings, in which.

DESCRIPTION OF PREFERRED EMBODIMENTS

Preferred embodiments of the present invention will be described hereinunder in detail with reference to the accompanying drawings.

Figure 1:
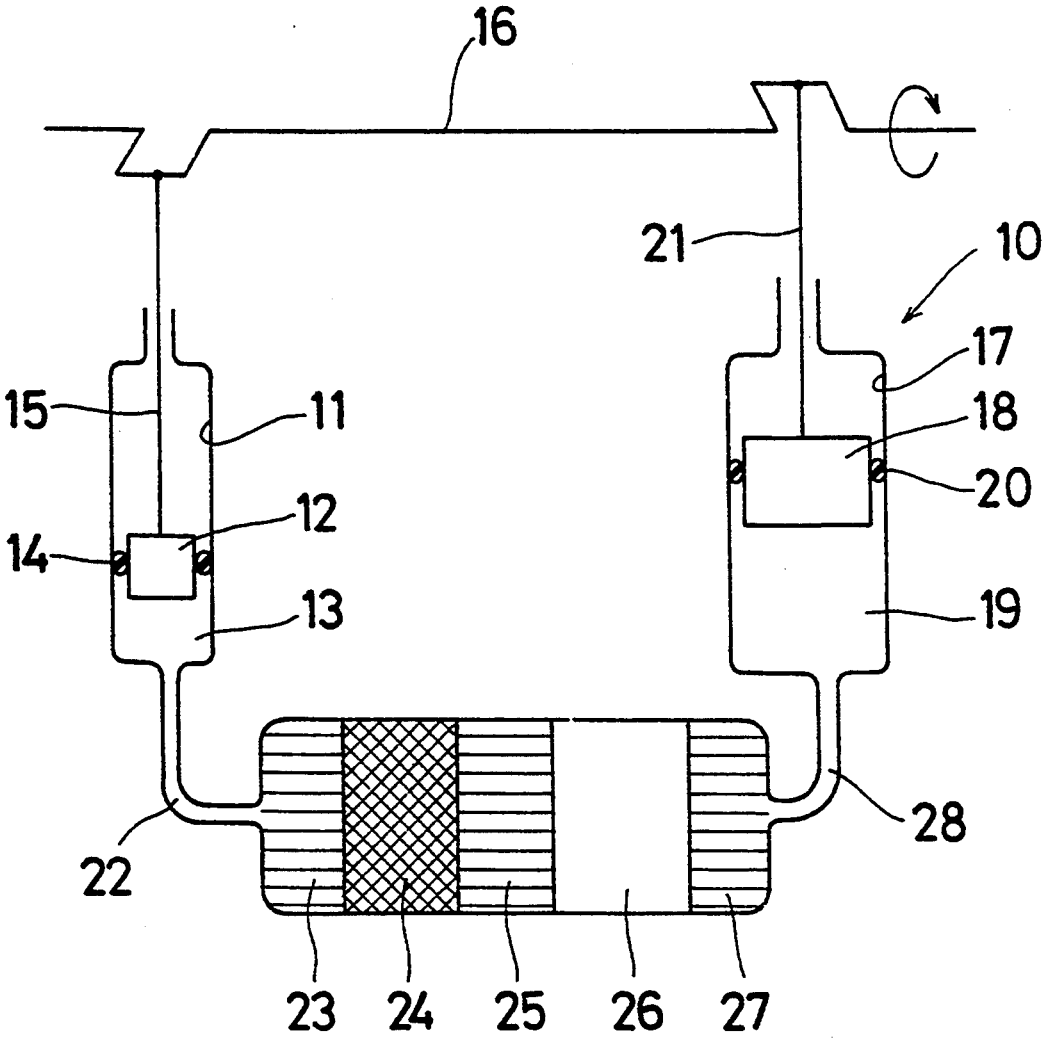
FIG. 1 is a cross-sectional view of a first embodiment of a Stirling engine in accordance with the present invention.

Referring first to FIG. 1 wherein a two-piston type Stirling engine 10 is schematically illustrated, the Stirling engine 10 includes a compression cylinder 11 in which a compression piston 12 is fitted so as to be movable in the vertical direction. A compression space 13 is defined between the compression cylinder 11 and the compression piston 12. A piston ring 14 is provided on the compression piston 12 for establishing a sealing connection therebetween. The compression piston 11 is operatively connected to a crank shaft 16 via a rod 15.

The Stirling engine 10 also includes an expansion cylinder 17 in which an expansion piston 18 is fitted so as to be movable in the vertical direction. An expansion space 19 is defined between the expansion cylinder 17 and the expansion piston 18. A piston ring 20 is provided on the expansion piston 18 for establishing a sealing connection therebetween. The expansion piston 18 is operatively connected to the crank shaft 16 via a rod 21.

The phase difference between the compression piston 12 and the expansion piston 18 depends on an angle which is made between the crank shaft 16 and each of the rods 15 and 21. In this embodiment, the expansion piston 18 is expected to advance 90 degrees relative to the compression piston 12. It is to be noted that this value is not requisite.

The compression space 13 is in fluid communication with the expansion space 19 via a passage 22, a cooling portion 23, a regenerator 24, a heating portion 25, a thermal isolating portion 26 which is a characterized portion of the present invention, a cooling portion 27 and a passage 28 which are arranged in this order. A continuous operating space is established which ranges from the compression space 13 to the expansion space 19. The operating space is filled with an operating or a working fluid such as a helium gas, a hydrogen gas, an argon gas or a nitrogen gas.

The heating portion 25 is expected to receive heat from a higher temperature external source such as fire, vapour, solar light or electric heater and the resultant heat is transmitted to the operating fluid. The cooling portion 23 is expected to transmit heat from the operating fluid to a lower temperature external source such as a room temperature water, room temperature atmosphere or similar device.

Due to a volume change at each of the compression space 13 and the expansion space 19, within the operating space, a well-known thermodynamic cycle is established and in the course of this cycle an amount of heat is moved from the heating portion 25 to the cooling portion 23 such that during this heat transfer a part of the heat is transformed into a work.

The regenerator 24 which is positioned between the heating portion 25 and the cooling portion 23 is expected to decrease the irreversible thermal transfer during the cycle in order to increase the conversion efficiency from heat to work.

The thermal isolating portion 26 serves for establishing a thermal isolation between the heating portion 25 and the expansion space 19 and is constructed in such a manner that a volume of the isolating portion 26 is greater than or equal to an exhaust volume of the expansion piston 18. Within the thermal isolating portion 26, in order to assure adiabalicall and reversible movement of the operating fluid, a sufficient span is set between opposed walls in the vertical direction. For example, if the configuration of the thermal isolating portion 26 is cylindrical with a radius of r, a relaxation time $\tau$ relating to heat exchange between the wall and the operating fluid is represented by a formula of $\tau = r^2/2\alpha$ where $\alpha$ is a coefficient of temperature expansion. If an angular velocity number is $\omega$, it is desirable that the radius r satisfy a formula of $\omega\tau >> 1$.

Like the thermal isolating portion 26, the cooling portion 27 serves for isolating the expansion space 19 from the heating portion 25. Providing the cooling portion 27 between the isolating portion 26 and the expansion space 19 will improve the thermal isolation thereof from the expansion space 19. It is to be noted that such a provision of the cooling portion 27 is not requisite.

The passage 22 is used for establishing a fluid communication between the compression portion 13 and the cooling portion 23, and the passage 28 is used for establishing a fluid communication between the expansion portion 19 and the cooling portion 27. Unless the cooling portion 27 is provided, the passage 28 is directly connected to the thermal isolating portion 26.

In addition, upon adjoining the compression space 13 to the cooling portion 23, the passage 22 is not required. Similarly, if the expansion space 19, adjoins the cooling portion 27 and/or the cooling portion 27 is omitted, no passage 28 is required.

Moreover, when the volume of the expansion space 19 becomes the minimum which is not less than the exhaust volume of the expansion piston 18 as well as when a portion of the expansion space 19 which can not be exhausted by the expansion piston 18 acts as a space for isolating thermally the expansion space 19 from the heating portion 25, the portion of the expansion space 19 is expected to be regarded as a part of the thermal isolating portion 26.

Figure 3:
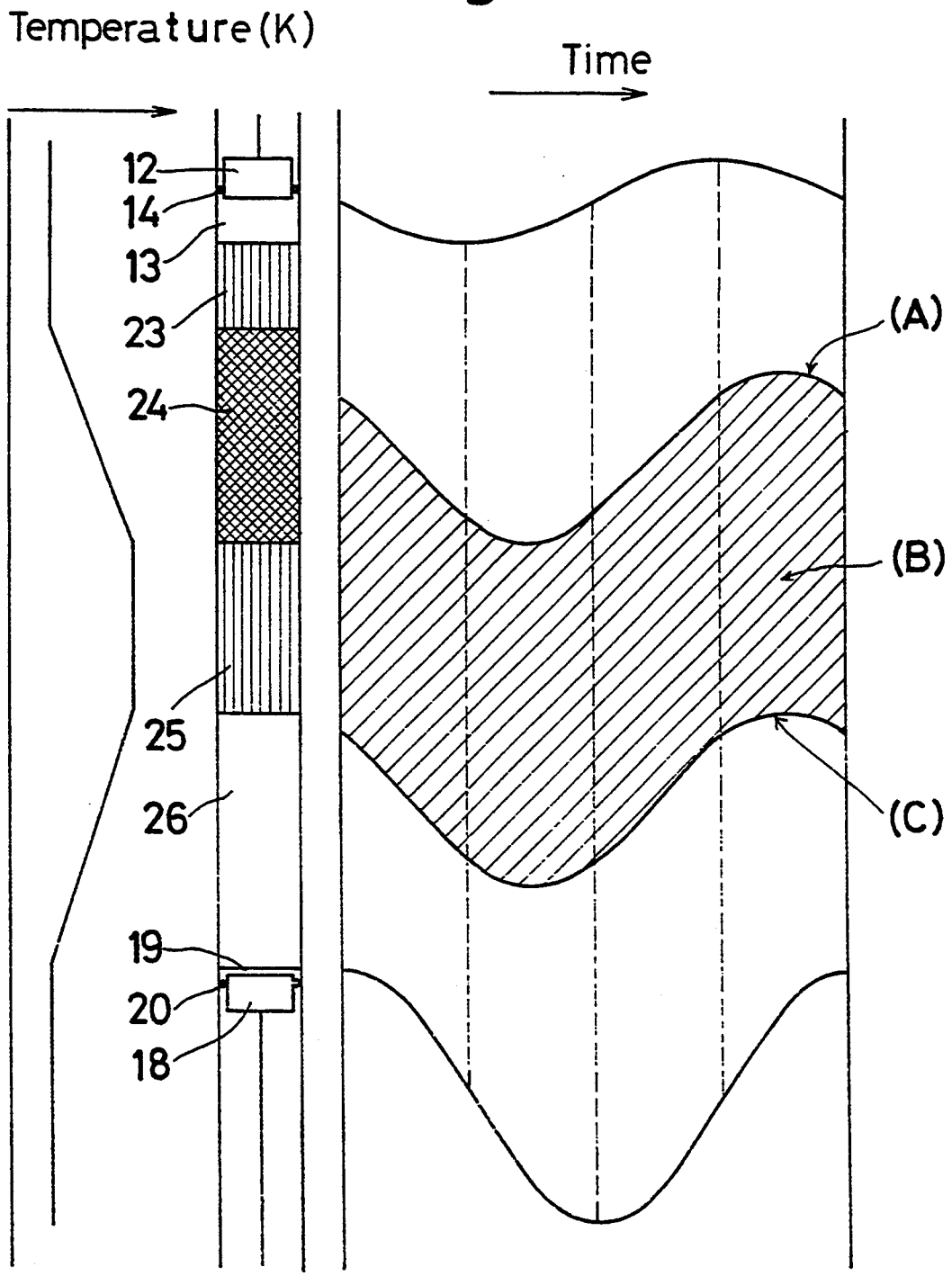
FIG. 3 is a view showing an operation of the Stirling engine shown in FIG. 1.

With reference to FIG. 3, an operation of the foregoing Stirling engine 10 is explained hereinafter. In the following explanation, the area of a cross-section of the operating space is constant, and it is to be noted that the cooling portion 27, the passage 22 and the passage 28 are out of consideration. In addition, in FIG. 3, a reference character (A) denotes the displacement of the operating fluid at a side of the compression piston 12 when the compression piston 12 is at its lowermost position, a reference character (B) denotes the operating fluid contained in the heating portion 25 during one cycle of the operation, and a reference character (C) denotes the displacement of the operating fluid at a side of the expansion piston 18 when the expansion piston 18 is at its uppermost position.

Due to the fact that operating fluid is between the expansion piston 18 and the compression piston 12 both of which move in different phases, the phase displacement of the operating fluid is expected to vary or distribute continuously from the expansion piston 18 and the compression piston 12. The amplitude of the phase displacement of the operating fluid is expected to vary in a similar manner.

The shadowed portion in FIG. 3 shows a condition of the phase of the operating fluid when it is in the heating portion 25 for a while during one cycle.

In the regenerator 24, there is an as-shown temperature gradient from the temperature of the heating portion 25 toward that of the cooling portion 23. In a cycle, an energy conversion from heat to work is expected to be generated upon heat transfer between two different temperatures, and therefore in this embodiment the energy conversion is established mainly by a cycle process wherein an isothermal reversible heat exchange is made between the operating fluid and a heat retaining substance (not shown) in the regenerator 24.

Since the volume of the thermal isolating portion 26 is not less than the exhaust volume of the expansion piston 18, though the operating fluid, when it is fully displaced toward the expansion piston 18, reaches the heating portion 25, the operating fluid fails to reach the expansion space 19 even though it is fully displaced toward the expansion piston 18. In other words, the operating fluid fails to enter the expansion space 19 from the heating portion 25. In addition, in the heat insulating portion 26, due to the fact that a span between the walls is sufficiently large, a heat exchange occurs between the operating fluid and each of the walls, which results in a substantial adiabatic movement of the operating fluid. Thus, the expansion space 19 is isolated thermally from the heating portion 25, and the temperature of each of the expansion piston 18 and the piston ring 20 becomes the room temperature.

The energy of the work at the cycle process flows from the compression piston 12 toward the expansion piston 18. The energy of the work which is mainly increased in the regenerator 24 is expected to be supplied toward the expansion piston 18 without substantially being attenuated.

Figure 2:
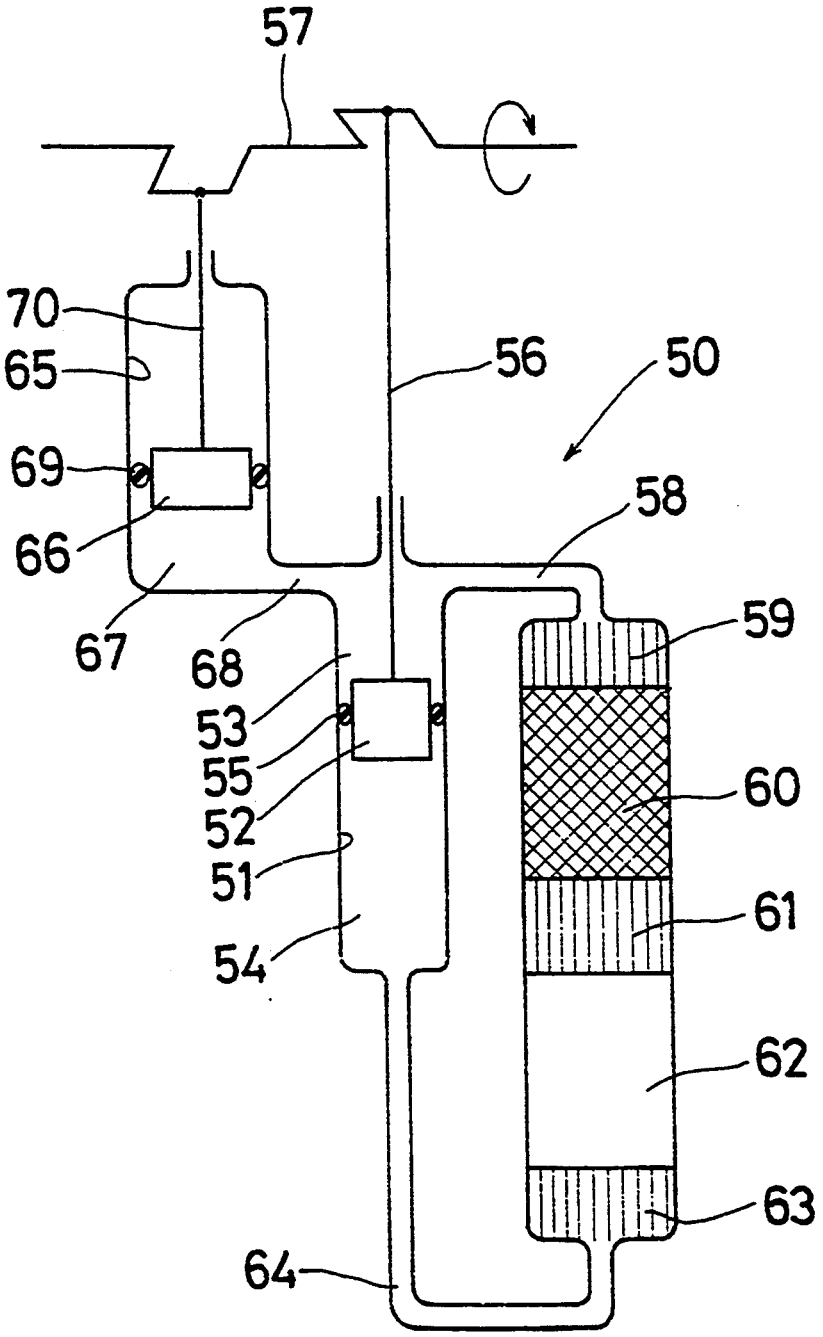
FIG. 2 is a cross-sectional view of a second embodiment of a Stirling engine in accordance with the present invention.

In FIG. 2, there is illustrated a displacer type Stirling engine 50 as a second embodiment of the present invention. The displacer type Stirling engine 50 includes a displacer cylinder 51 in which a displacer piston 52 is fitted so as to be moved in the vertical direction. The displacer piston 52 defines a space 53 and a space 54 within the displacer cylinder 51. At an outer periphery of the displacer piston 52, there is provided a piston ring 55 for establishing a sealing relationship between the displacer piston 52 and an inner surface of the displacer cylinder 51. The displacer piston 52 is operatively connected to a crank shaft 57 via a rod 56.

On the other hand, in the power piston cylinder 65, a power piston 66 is fitted so as to be moved in the vertical direction. The power piston 66 defines a space 67 within the power piston cylinder 65. At an outer periphery of the power piston 66, there is provided a piston ring 69 for establishing a sealing relationship between the power piston 66 and an inner surface of the power piston cylinder 65. The power piston 66 is operatively connected to the crank shaft 57 via a rod 70.

The phase difference between the displacer piston 52 and the power piston 66 depends on an angle which is made between the crank shaft 57 and each of the rods 56 and 70. In this embodiment, the displacer piston 52 is expected to advance 90 degrees relative to the power piston 66. It is to be noted that this value is not requisite.

The space 54 is in fluid communication with the space 67 via a passage 58, a cooling portion 59, a regenerator 60, a heating portion 61, a thermal isolating portion 62 which is a characterized portion of the present invention, a cooling portion 63 and a passage 64 which are arranged in this order. Such an arrangement establishes a continuous operating space which is filled with an operating or a working fluid such as a helium gas, a hydrogen gas, an argon gas or a nitrogen gas.

It is to be noted that in the second embodiment the spaces 53 and 67 constitute a compression space and the space 54 constitutes an expansion space.

The heating portion 61 is expected to receive heat from a higher temperature external source such as fire, vapour, solar light or electric heater and the resultant heat is transmitted to the operating fluid. The cooling portion 59 is expected to transmit heat from the operating fluid to a lower temperature external source such as room temperature water, room temperature atmosphere or similar device.

The thermal isolating portion 62, like the thermal isolating portion 26 of the first embodiment, serves for establishing a thermal isolation between the heating portion 61 and the space 54 and is constructed in such a manner that a volume of the isolating portion 62 is greater than or equal to an exhaust volume of the displacer piston 52. Within the thermal isolating portion 62, in order to assure adiabalicall and reversible movement of the operating fluid, a sufficient span is set between opposed walls in the horizontal direction. For example, if the configuration of the thermal isolating portion 62 is cylindrical with a radius of r, a relaxation time $\tau$ relating to heat exchange between the wall and the operating fluid is represented by a formula of $\tau = r^2/2\alpha$ where $\alpha$ is a coefficient of temperature expansion. If an angular velocity number of the crank shaft 57 is $\omega$, it is desirable that the radius r meets with a formula of $\omega\tau >> 1$.

Like the thermal isolating portion 62, the cooling portion 63 serves for isolating the space 54 from the heating portion 61. Providing the cooling portion 63 between the isolating portion 62 and the space 54 will improve the thermal isolation thereof from the space 61. It is to be noted that such a provision of the cooling portion 63 is not requisite.

The passage 58 is used for establishing a fluid communication between the space 53 and the cooling portion 59, and the passage 68 is used for establishing a fluid communication between the space 54 and the cooling portion 63. Unless the cooling portion 63 is provided, the passage 64 is directly connected to the thermal isolating portion 62 and the space 54.

In addition, upon adjoining the space 53 to the cooling portion 59, the passage 58 is not required. Similarly, if the space 53 adjoins the space 67, the passage 68 is not required, and if the space 54 adjoins the cooling portion 63, no passage 64 is required. Moreover, unless the cooling portion 63 is provided when the space 54 is next to the thermal isolating portion 62, the passage 64 is also not required.

When the volume of the passage 64 is not less than the exhaust volume of the displacer piston 52 and acts as a function for isolating thermally the space 54 from the heating portion 61, the passage 64 can be regarded as a part of the thermal isolating portion 62.

When the volume of the space 54 becomes the minimum which is not less than the exhaust volume of the displacer piston 52 and acts as a function for isolating thermally the space 54 from the heating portion 61, the portion of the space 54 is expected to be regarded as a part of the thermal isolating portion 62.

An operation of the displacer type Stirling engine 50 is not explained due to the similarlity between the Stirling engines 10 and 50 in operation.

It is also to be noted that the present invention can be applied to a Stirling engine such as a double acting type Stirling engine other than the foregoing devices.

As mentioned above, providing the thermal isolating portion between the expansion space and the heating portion will establish thermal isolation of the expansion space from the heating portion, which results in prolonged life of the expansion piston and its piston ring which constitute the expansion space. This means that the expansion piston (the piston ring of the expansion piston) becomes more free from restrictions such as raw material and structure.

The inventions has thus been shown and described with reference to specific embodiments, however, it should be noted that the invention is in no way limited to the details of the illustrated structures but changes and modifications may be made without departing from the scope of the appended claims.

What is claimed is:

1. A Stirling engine comprising:

a compression cylinder in which is disposed a compression piston to define a compression space within the compression cylinder;

an expansion cylinder in which is disposed an expansion piston to define an expansion space within the expansion cylinder;

an operating space located between the compression space and the expansion space and filled with an operating fluid;

a cooling portion, a regenerator and a heating portion arranged in this order from the compression space to the expansion space and provided in the operating space;

a thermal insulating space provided between the expansion space and the heating portion; and a cooling means provided between the thermal insulating space and the expansion space.

2. The Stirling engine according to claim 1, including a first rod connected to the compression piston and a second rod connected to the expansion piston, the first and second rods being connected by a crank shaft.

3. The Stirling engine according to claim 1, wherein the thermal insulating space possesses a volume not less than a maximum volume of the expansion space.

* * * * *